US006105314A

United States Patent [19]

Stocksieker

[11] Patent Number: 6,105,314

[45] Date of Patent: Aug. 22, 2000

[54] PANEL SYSTEM

[76] Inventor: Richard Stocksieker, Ding Le Hill Rd., Andes, N.Y. 13731

[21] Appl. No.: 08/692,387

[22] Filed: Aug. 5, 1996

[51] Int. Cl.[7] ..... E04B 7/00

[52] U.S. Cl. ..... 52/95; 52/792.11

[58] Field of Search ..... 52/90.1, 95, 302.3, 52/792.1, 792.11

[56] References Cited

U.S. PATENT DOCUMENTS

| | | | |
|---|---|---|---|
| 3,218,773 | 11/1965 | Heirich | 52/95 X |
| 3,535,844 | 10/1970 | Glaros | 52/792.1 X |
| 3,579,940 | 5/1971 | Greenleaf | 52/542 |
| 3,998,024 | 12/1976 | Frandsen | 52/792.1 X |
| 4,102,106 | 7/1978 | Golder et al. | 52/533 |
| 4,107,892 | 8/1978 | Bellem | 52/792.1 X |
| 4,123,885 | 11/1978 | Scott | 52/792.1 X |
| 4,184,301 | 1/1980 | Anderson et al. | 52/792.1 X |
| 4,244,151 | 1/1981 | Seem | 52/90.1 X |
| 4,278,071 | 7/1981 | Brill-Edwards . | |
| 4,408,423 | 10/1983 | Lautensleger et al. | 52/90.1 |
| 4,433,514 | 2/1984 | Henges, Jr. | 52/94 |
| 4,445,305 | 5/1984 | Orie, Sr. | 52/309 |
| 4,575,981 | 3/1986 | Porter | 52/309.9 |
| 4,725,471 | 2/1988 | Imhoff | 52/792.1 X |
| 4,870,798 | 10/1989 | Richter | 52/528 |
| 5,305,570 | 4/1994 | Rodriguez | 52/520 |
| 5,438,810 | 8/1995 | Bullen | 52/539 |

*Primary Examiner*—Lanna Mai

[57] ABSTRACT

A panel system for use on walls and roofs with alternating upper and lower panels, side by side, in a generally vertical orientation, the upper panels being mounted on a filler board with a notch formed at the base of the filler board on both vertical edges, the lower panel being locked into the notch and the vertical edges of the upper panels being folded over the edges of the lower panels to form a sealed joint and retain both panels in place.

6 Claims, 4 Drawing Sheets

PANEL SYSTEM

BACKGROUND OF THE INVENTION

A wide variety of coverings for wall and roofs of buildings both commercial and residential are well known. In years past, it was common for expensive residential and commercial property to have metal roofs, usually made of copper. The cost of such roofing became intolerably high not only due to the cost of the material but due to the high labor cost. Today, workmen who can do such work are difficult to find and the installation of such material is generally recognized as a nearly lost art. New materials such as aluminum and plastic are now available and even copper can still be used if a means of installation, not requiring special skills and permitting rapid installation, were available.

This invention provides a panel system with two alternating panels which can be preformed in specified lengths and placed on a surface such as a wall or roof and rapidly locked to the surface and sealed to one another.

SUMMARY OF THE INVENTION

In accordance with the present invention, a pairs of panels are provided. The panels are affixed to the surface in a generally vertical orientation. On a wall, the panels would be straight up and down and on a roof the panels would extend from the bottom of the slope of the roof to the top of the roof. The invention could also be used on a flat roof but probably would not be as advantages since a flat roof is usually not visible and is easily coated with asphalt compounds.

The panels are installed with an upper panel and a lower panel alternating with one another. The upper panel is located over a filler member which has notches along both lower edges. The lower panel is constructed with protrusions along its lower edges which fit into the notches. The filler member is secured to the surface being covered and the placement of the protrusions into the notches secures the lower panel to the roof. The lower panel also has a top edge which is bent inwardly to be generally parallel to the panel itself. The upper panel side edges of the upper panels are bent downwardly and under the upper panel for approximately one hundred eighty degrees to form, in essence, a sideways U which locks onto the edge of the lower panel. Tabs may also be affixed to the filler member and the edges of the upper panel are then bent around both the adjacent edge of the lower panel and the tabs located by that edge. The use of tabs provides added strength in holding the upper panel to the roof.

It is an object of the present invention to provide a panel system that is easy to install.

It is a further object of the present invention to provide a panel system that is rigidly secured to the surface of the roof and is free of exposed nail and screw holes.

It is a further object of the present invention to provide a panel system that has a long life.

It is a further object of the present invention to provide a panel system that is esthetically attractive.

The subject matter of the present invention is particularly pointed out and distinctly claimed in the concluding portion of the specification. However, both the organization and method of operation, together with further advantages and objects thereof, may be best understood by reference to the following description taken in conjunction with the accompanying drawings wherein like reference characters refer to like elements.

DETAILED DESCRIPTION OF THE INVENTION

Figure 1:
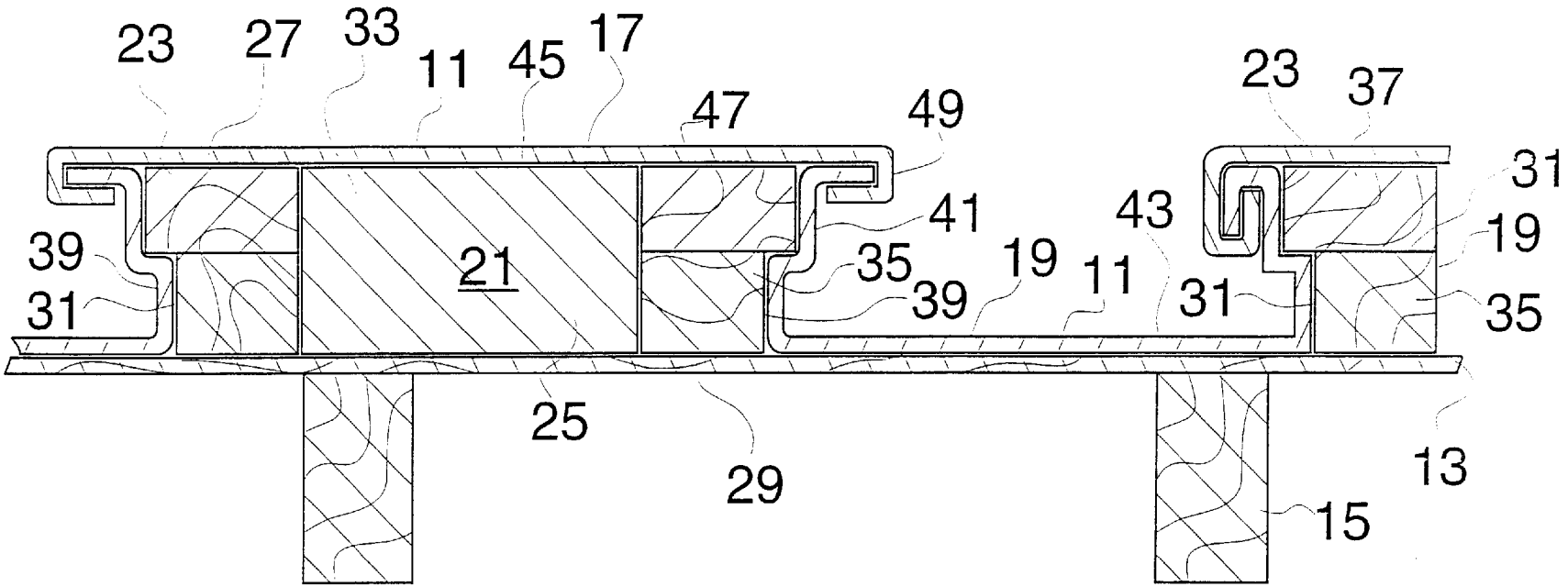
FIG. 1 is a cross-sectional end view at substantially right angles to the panel showing the configuration of the upper and lower panels and showing the interlocking of the two panels with the interlocking of the two panels in both the horizontal position ad bent down at right angles thereto.

Referring now to the drawings and more particularly to FIG. 1, a series of panels 11 is shown on the base surface 13 which is supported by rafters 15. Two separate panels 11, which alternate, are shown including an upper panel 17 and a lower panel 19. The upper panel 17 and the lower panel 19 may have different widths. However, the width of both the upper panels 17 and the lower panels 19 may also be substantially the same.

Beneath each of the upper panels 17, a base member 21 is located. The base member 21 is preferably formed from several parts but can be formed from only one part. The base member 21 has two edges 23 and two ends 25 and a top surface 27 and a bottom surface 29 which is against the base surface 13 being covered such as a wall or a roof. The lower section of both edges 23 of each base member 21 are indented forming a notch 31. The notch 31 has a height of approximately one-half the height of the edge 23 of the base member 21 and the notch 31 extends from the bottom of the base member 21 approximately halfway up the edge 23 of the base member 21 from the base surface 13. The notch 31 preferably has a rectangular cross-section. Rather than construct the base member 21 from one piece of material and form the notch 31, a central member 33 is used which can be formed from particulate board so as to be as inexpensive as possible. Each edge 23 of the base member 23 is then preferably formed from a lower side member 35 and an upper side member 37 both of which have a thickness of approximately half the thichness of the central member 33 and whose combined thickness totals the thickness of the central member 33. The upper side member 37 is wider than the lower side member 35 and extends outwardly beyond the lower side member 35 so as to form the notch 31. Use of a lower side member 35 and an upper side member 37 results in savings in forming the notch 31. By use of very inexpensive material to form the central member 33 further savings are achieved.

Before placing the panels 11 in place on the base surface 13, it is essential to first place the central members 33 in the location which must be measured to assure proper fitting of the upper panels 17 and the lower panels 19. The base members 21 are then installed in one piece or in several pieces as has been previously explained. If installed in one piece, the base members 21 must not be secured until the lower panels 19 are in place. With a series of pieces, the central member 33 can be installed and the lower side members 35 also secured. The lower panel 19 is then installed and the upper side members 37 are affixed to the lower side members 35.

The lower panels 19 are formed with a cross section which is the reverse of the base members 21, namely the lower half of each lower panel 19 is wider than the upper half of each lower panel 19, forming a protrusion 39 along the bottom of both edges 41 of the lower panels 19. The protrusions 39 have a cross section substantially the same as the notch 31 so that the protrusions 39 fit in the notch 31. Each lower panel 19 has a bottom sheet 43 which rests on the base surface 13. The lower panel 19 has the two side edges 41 which extend upwardly from the bottom sheet along the edges 23 of the adjacent base members 21. The edges 41 of the lower panels 19 then bend inwardly toward one another in alignment with the top surface 27 of the base member 21 forming a pair of lips 44.

Once the lower panels 17 are in place, the upper side members 37 are installed and secured to the lower side members by fasteners, such as screws or nails. Once the upper side members 37 are in place, the lower panels 19 are firmly held in place.

The bottom sheet 43 of the lower panel 19 is directly against the base surface 13 being covered. The lower panels 19 have protusions 39 along their edges 41, as have been previously described, and the edges 41 extend upwardly substantially at right angles from the bottom sheet 43, then bend inwardly toward one another to fit within the notches 31 and then bend upwardly from the protusions 39. The edges of the lower panels 19 extend generally perpendicular to the bottom sheet 43 from the notch 31 to a heighth parallel to the heighth of the base member 21.

The upper panels 17 are a flat sheet with an inner surface 45 and an outer surface 47. The inner surface 45 is against the top surface 27 of the base member 21. The upper panels 17 have a width which is slightly greater than the sum of the width of the base member 21 and the width of the two adjoining lips 44 of the two lower panels 19 on each side of the upper panel 17. The upper panels 17 also have edges 49 which bend downwardly only slightly and then turn inwardly under the inner surface 45 of the upper panel 17 itself. Therefore, at the edges, the upper panels 17 have U-shaped channels 51 turned sideways forming U-shaped channels 51 to fit over the lips 44 of the lower panels 19. The U-shaped channels 51 of the upper panel 17 fit over the lips 44 of the lower panels 19. For purposes of installation, one edge 49 of each upper panel 17 is initially bent only downwardly to permit installation over the lips 44 after the other U-shaped channel 51 is slid over the lip 44 of the lower panel 19 on the other side of the upper panel 17 being installed. Once in place, that one edge 49 of each upper panel 17 is bent further around the lip 44 rigidly to secure the upper panel 17 to the lower panel 19.

Figure 2:
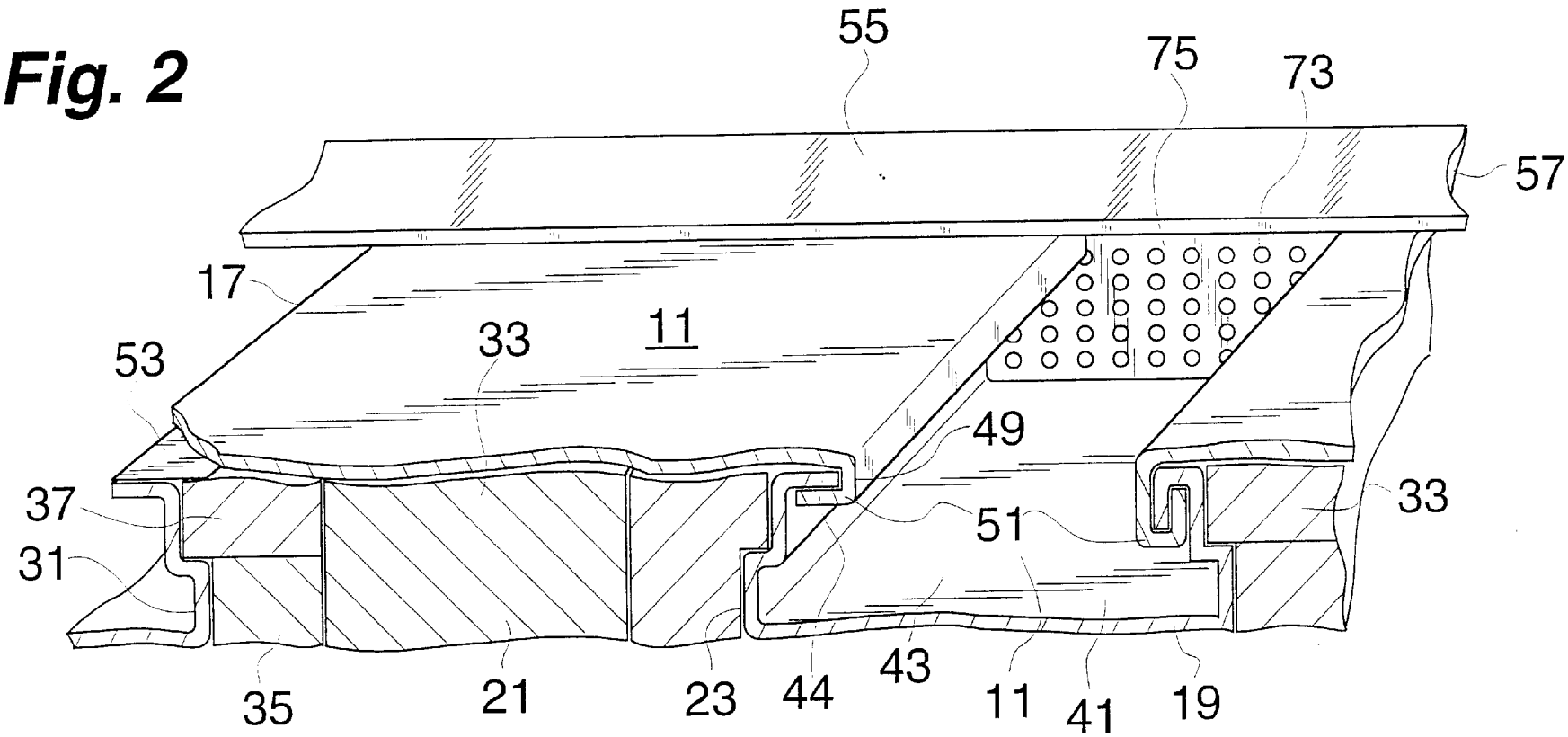
FIG. 2 is a pictorial view of the panels showing a peak section with an air intake.
Figure 3:
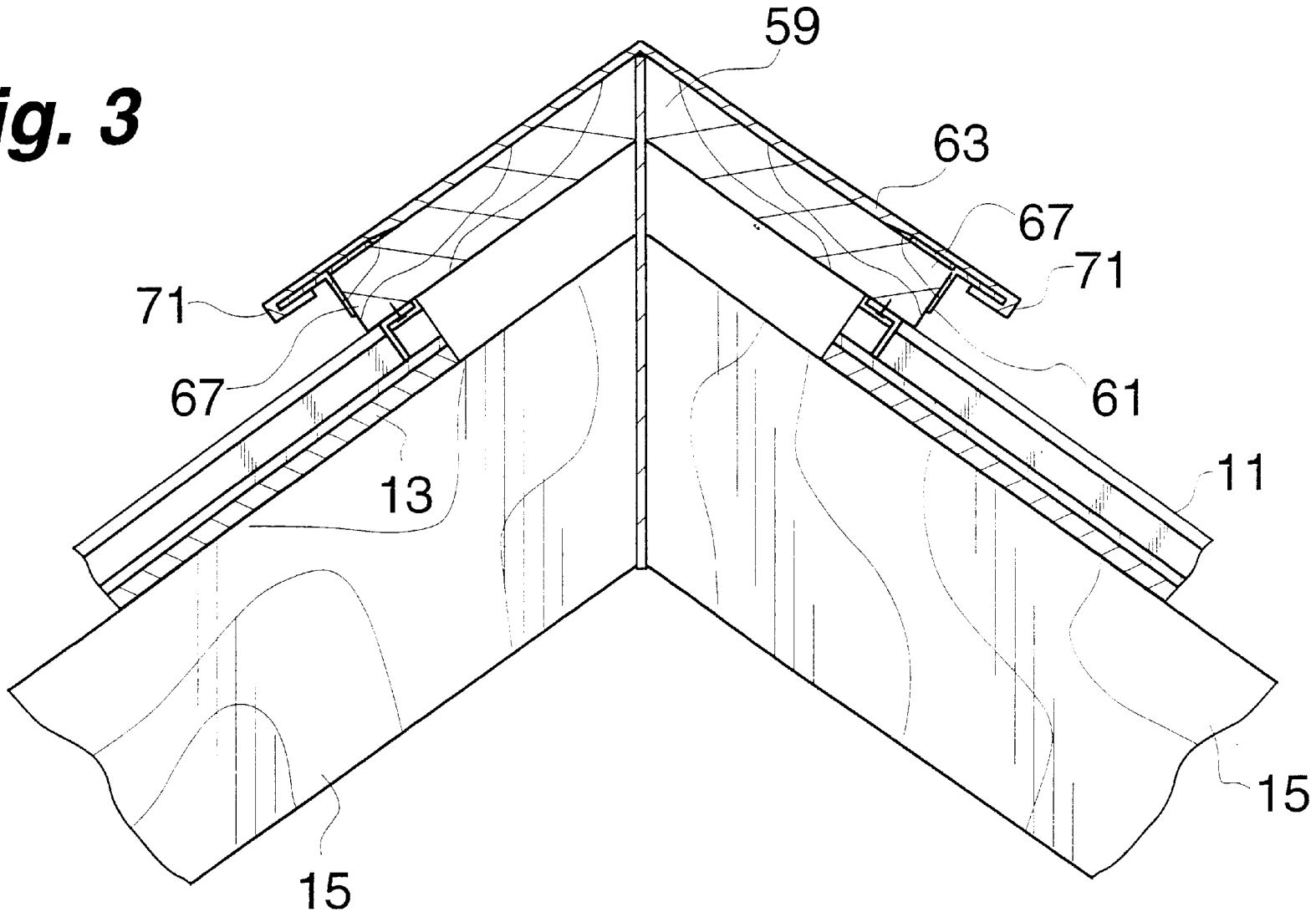
FIG. 3 is a side elevation partially broken away of the peak portion of a roof using the panels and showing a cap in place.

In order to provide even geater security in assuring the retention of the panel system on the base surface being covered, reinforcing strips 53 may be used to provide even greater strength. As best seen in FIG. 2, the reinforcing strips 53 may be secured along the edges 23 of the base member 21 to extend over the lips 44. The reinforcing strips 53 are affixed to the base member 21 by nailing and to avoid corrosion should be made from the same metal as is used in the upper panels 17. When reinforcing strips 53 are used, the U-shaped channels 51 are secured around the reinforcing strips 53 and the lips 44.

In a metallic installation, the U-shaped channels 51 and the lips 44, as well as the reinforcing strips 53, if present, are bent downwardly, and pressed against the edges 49 of the lower panels 19. This can be achieved by use of a mallet and results in a panel system rigidly secured and water tight.

The panels 11, which can be made from aluminum or copper, in the event a metallic covering is desired, may also be formed from plastic but, in that event, the U-shaped channels 51 and lips 44 would riot be bent downwardly as is recommended for a metallic installation. With plastic, the ability to bend a channel closed is not readily possible, but limited bending of the lips 44 and the U-shaped channels 51 permits securely fitting the upper panel 17 onto the lower panel 19.

With plastic, an adhesive needs to be used to assure a secure and waterproof juncture at the U-shaped channels 51 and the lips 44.

If the panels 11 are applied to a vertical wall, such as the side of a building, the ends will abut other parts of the building such as an overhang and a foundation. In the case of a roof, a face panel (not shown) will be required to close the lower end of the upper panel 17.

Caps 55 may also required. Where a cap 55 is used, a pair of peak members 57 are used which abut one another at a peak angle 59. Such cap 55 is needed where the base surface 13 includes two surfaces which abut one another at such peak angle 59. The peak members 57 extend substantially at right angles to both the lower panels 19 and the upper panels 17 at the point where the surfaces abut.

Figure 4:
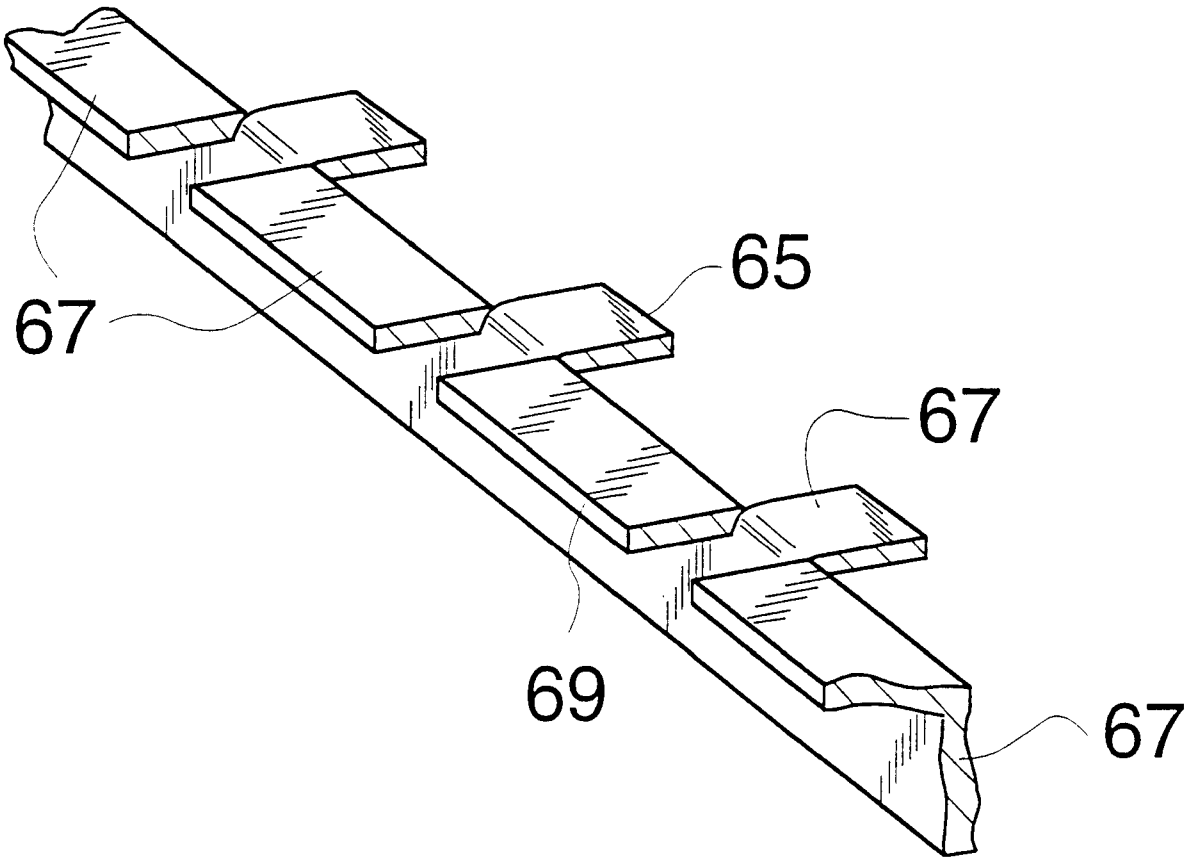
FIG. 4, a pictorial view of the angle member used to hold the cap in place.

A pair of angle members 61, as seen in FIG. 4, are used to hold a cap member 63 on the peak members 57. Tabs 65 are formed from one section of the two sections 76 of the angle member 61 and bent over in line with the section 67 from which the tabs 65 are formed. These tabs 65 are secured to the peak members 57 leaving one section 67 of the angle member 61 forming a lip 69 similar to the lip 44 of the lower panel 19. The other section 67 of the angle member 61 covers the edge of the peak member 71 on which it is located.

A space 73 is formed between the peak members 71 and the lower panel 19 which can be used as a source of ventilation that is covered from the elements. A vent member 75 is then installed to prevent unwanted animals and debrie from entering the space 73.

Thus while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. A panel system for use on walls and roofs comprising:

a base surface;

a series of base members with two edges and a top surface and secured to the base surface, the base member including a central member having a rectangular cross section and two edges, a pair of lower side members located on both of the two edges of the central member and having a rectangular cross section, a pair of upper side members mounted on the sides of each central member and on the lower side members, the upper side members having a rectangular cross section and extending from the central member farther than the lower side members to form a pair of notches along the sides of each base member adjacent to the base surface;

a lower panel mounted between the base members, the lower panel having a bottom sheet resting on the base surface and having two edges extending upwardly from the bottom sheet within the notches and along the edges of the adjacent base members and being bent inwardly toward one another in alignment with the top surface of the base member forming a pair of lips; and an upper panel mounted on the base member including a top sheet mounted on the upper surface of the base member and having two edges, each edge being tightly bent around and underneath itself forming a U-shaped channel, each of the U-shaped channels being locked around the adjoining lips of the adjacent lower panel and each lip and U-shaped panel being bent downwardly against the respective lower panel.

2. A panel system according to claim 1 further including strips affixed to the top surface of the base member and extending across the lips of the lower panel to increase the thickness thereof.

3. A panel system for use on walls and roofs comprising:

a base surface;

a series of base members with two edges and a top surface mounted on and secured to the base member, each of the two sides of the base member having a notch therein adjacent the base surface, each notch having a rectangular cross section;

a lower panel mounted on the base surface between the base members, each having two edges extending into the adjacent notches and along the edges of the adjacent base members and being bent inwardly toward one another in alignment with the upper surface of the base member; and a series of upper panels mounted on the base member including a top sheet mounted on the upper surface of the base member, each having two edges, each edge being tightly bent around land underneath itself forming a U-shaped channel, each of the U-shaped channels being locked around the adjoining lips of the adjacent lower panel.

4. A panel system according to claim 3 wherein each lip and U-shaped channel are bent downwardly against the respective lower panel.

5. A panel system for use on walls and roofs comprising:

a base surface including two sloping surfaces meeting each other at a peak;

a series of base members with two edges and a top surface mounted on and secured on and secured to the base member, each of the two edges of the base member having a notch therein adjacent the base surface, each notch having a rectangular cross section;

a series of lower panels mounted on the base surface between the base members and having two edges extending into the adjacent notches and along the edges of the base member and being bent inwardly toward one another in alignment with the upper surface of the base members;

a series of upper panels mounted on the base member including a top sheet mounted on the top surface of the base member and having two edges, each edge being tightly bent around underneath itself forming a U-shaped channel, each of the U-shaped channels being locked around the adjoining lips of the adjacent lower panel; and a roof cap mounted on the peak of the roof.

6. A panel system according to claim 5 wherein the roof cap includes:

a pair of peak members abutting each other at a peak angle extending substantially at right angles to both the lower panels and the upper panels at the point where the surfaces of the base surface meet;

a pair of angle members with tabs formed from one section of the angle member and bent over in line with the section from which the tabs are formed, the tabs of each angle member being secured to a separate one of the pair of abutting peak members; and a cap sheet bent at substantially at the peak angle and having two edges, each edge being bent tightly around to form a pair of channels, each U-shaped channel being fitted over one section of one of the pairs of angle members.

* * * * *